US005237378A

United States Patent [19]

McEwen

[11] Patent Number: 5,237,378

[45] Date of Patent: Aug. 17, 1993

[54] COPIER/PRINTER EMPLOYING A ROLL MEDIA FEED APPARATUS AND DUAL FUNCTIONS SENSORS

[75] Inventor: David J. McEwen, Palmyra, N.Y.

[73] Assignee: Xerox Corporation, Stamford, Conn.

[21] Appl. No.: 888,959

[22] Filed: May 26, 1992

[51] Int. Cl.[5] ..... G03G 21/00

[52] U.S. Cl. ..... 355/309; 355/203; 355/316

[58] Field of Search ..... 355/308-311, 355/316, 321, 72, 206, 203, 208; 226/25; 340/675; 250/561; 83/208-210

[56] References Cited

U.S. PATENT DOCUMENTS

| | | | |
|---|---|---|---|
| 3,743,413 | 7/1973 | Sharp et al. | 83/208 X |
| 3,859,649 | 1/1975 | Slack | 355/310 X |
| 3,879,123 | 4/1975 | Fisher | 355/301 |
| 4,058,037 | 11/1977 | Tashiro et al. | 83/70 |
| 4,089,900 | 4/1978 | Yamaoka et al. | 355/206 |
| 4,307,957 | 12/1981 | Kitagawa et al. | 355/206 |
| 4,641,272 | 2/1987 | Sasaki et al. | 250/561 X |
| 4,707,704 | 11/1987 | Allen et al. | 355/213 X |
| 4,821,974 | 4/1989 | Poehlein | 242/68.4 |
| 4,885,613 | 12/1989 | Kudoh | 355/310 |
| 4,980,717 | 12/1990 | Kiguchi | 366/316 X |
| 4,984,029 | 1/1991 | Nishikawa | 355/310 |
| 4,996,556 | 2/1991 | Gray, Jr. | 355/50 |
| 5,040,777 | 8/1991 | Bell et al. | 271/3 |
| 5,124,759 | 6/1992 | Fukuchi et al. | 355/316 |

*Primary Examiner*—A. T. Grimley
*Assistant Examiner*—Wiliam J. Royer

[57] ABSTRACT

A copier/printer that employs a plurality of roll media includes a paper path monitored by a plurality of dual use sensors. the first use of the sensors is to initialize the lead edge of each media roll and the second use of the sensors is as jam detectors. When media is coming from a position lower than other media rolls, each sensor along the paper path is used in a timing sequence to monitor the media lead edge and indicate a jam if the media does not reach particular sensors in accordance with the timing sequence.

7 Claims, 2 Drawing Sheets

COPIER/PRINTER EMPLOYING A ROLL MEDIA FEED APPARATUS AND DUAL FUNCTIONS SENSORS

This invention relates to a copier/printer employing a roll media feed apparatus and, more particularly, to a dual purpose media sending system for use with such an apparatus.

Copying relatively large size documents such as engineering drawings and the like normally requires that the copy, media material be supplied from a roll assembly. As a result, it is necessary that the media material be cut to size from the roll being used, and for this purpose, a cut media roll supply is desirable. Typically, a cut, media roll supply of the type referred to herein includes a roll support which holds and permits the roll to be unwound as sheets are cut therefrom, and a sheet cutter such as a rotary cutter which cuts or severs the sheet material in two. Also conventional is a handling apparatus for unwinding the media material from the supply roll and advancing a length selected to the sheet cutter, and a machine control system for integrating and synchronizing operation of the various components. It is also desirable that the sheet cutter be able to cut, with the utmost reliability and accuracy, a wide range of media materials such as bond, vellum, film, tracing paper and the like in addition to a wide range of paper weights. For example, prior art rotary bar type cutters as disclosed in U.S. Pat. Nos. 4,058,037 and 3,879,123, both of whose contents are hereby incorporated by reference. However, major problems with roll media feeders include ensuring that the roll media has been loaded into the machine properly; ensuring that media of not-in-use rolls is out of the feed path of in-use media; and the requirement for large quantities of sensors to monitor various media related functions.

It is therefore an object of this invention to provide a roll media feed system that is economical and easy to position the lead edge thereof into a predetermined feed position during media loading.

Accordingly, the present invention provides a three roll media feed system that employs three sensors with dual functions. The first function of each sensor is to automatically initialize the lead edge of the media for each roll and the second function is to serve as jam detectors.

Figure 1:
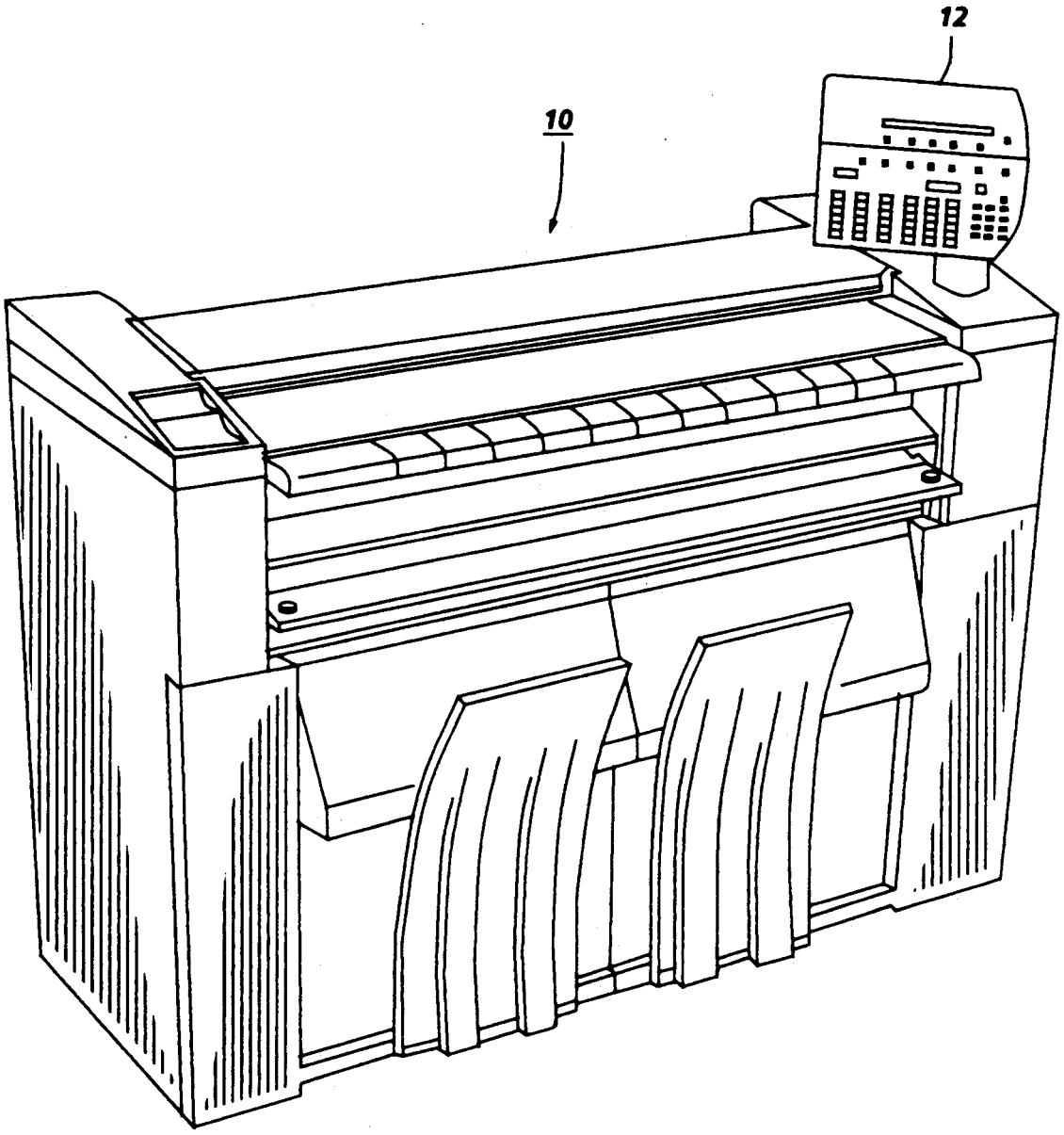
FIG. 1 is an isometric view of a copier/printer which employs the dual use sensors of the present invention.
Figure 2:
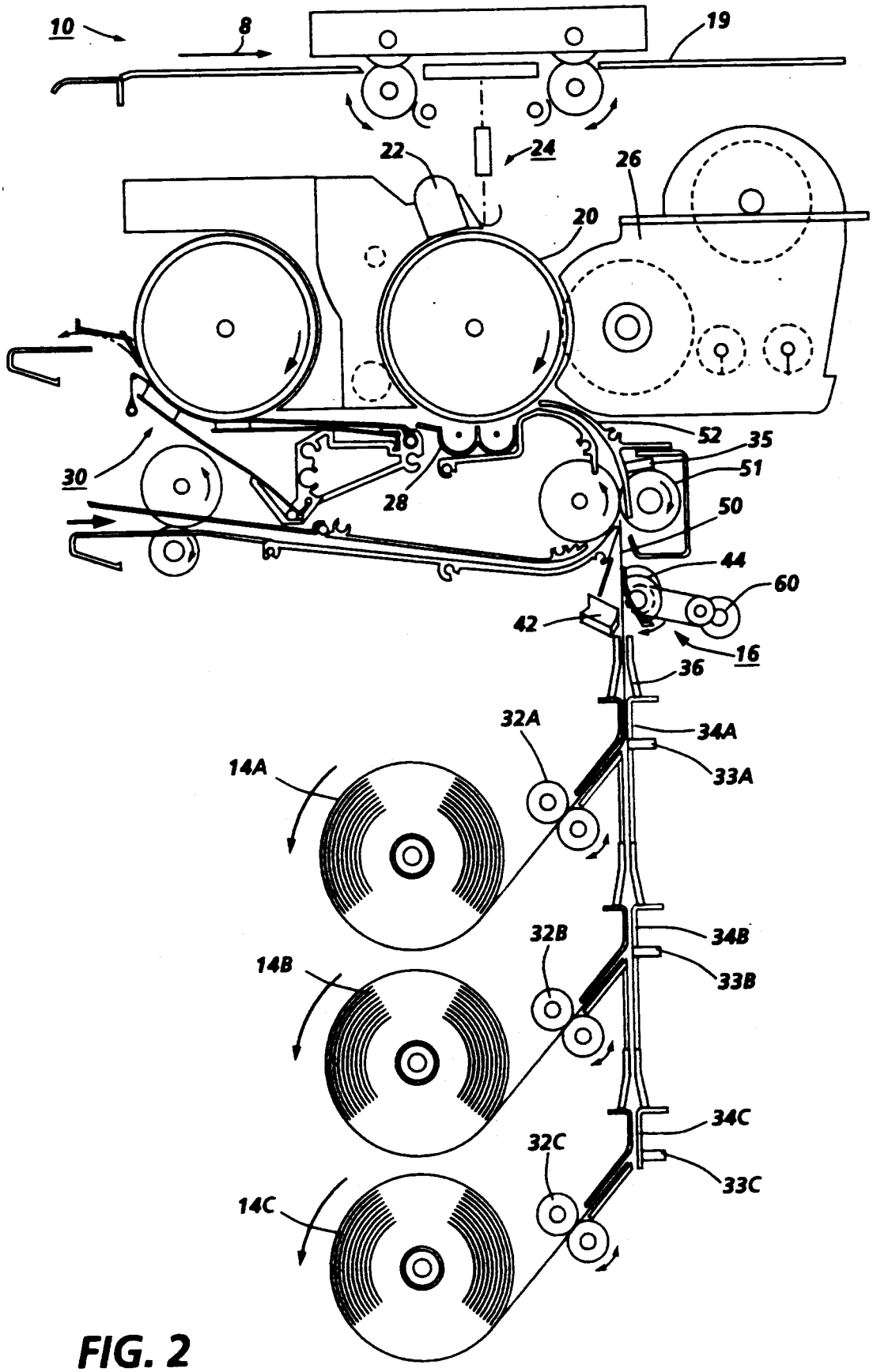
FIG. 2 is a partial, exploded, schematic side view of the copier/printer of FIG. 1 showing the placement of the dual use sensors of the present invention.

Referring now to the drawings in detail wherein like numbers represent like elements, in FIG. 1 a wide format copier/printer 10 including a control panel 12 is shown which is especially adapted to copy large documents. Documents to be copied are fed in from the front of the machine, pass through an exposure zone and exit out of the back of the machine. FIG. 2 shows a side internal view of the copier/printer machine 10. Machine 10 includes an electrostatic drum 20 with xerographic stations arranged around its periphery, which carry out the operational steps of the copying process. These stations include charging station 22, exposure station 24, developing station 26, transfer station 28 and fusing station 30. Documents fed along the platen 19 in the direction of arrow 8 are imaged onto the surface of drum 20, at exposure station 24. The operations of the stations are conventional and are described, for example, in U.S. Pat. Nos. 4,821,974; 4,996,556; and 5,040,777, whose contents are incorporated herein by reference.

Copy media, which may be bond paper, vellum, or the like, is cut from the selected media roll assembly 14A, 14B or 14C and is fed by a respective feed roller pair 32A, 32B or 32C. The sheet to be cut is guided along a vertical path between baffle pairs into the sheet cutting bar assembly 16 which includes a stationary blade 42 and a rotating cutting bar 44 that includes a helical cutting blade. Cutter bar 44 is shown in the home position which is about 30° of rotation away from the cutting position and is driven by motor 60. Cutter assembly 16 is of the type described, for example, in U.S. Pat. No. 4,058,037, referenced supra. Initiated by a cutter operation signal, bar 44 rotates in the direction of the arrow with its blade moving against blade 42 to sheer a sheet 50 from the roll media with a straight cut. The cut sheet is transported after registration by roller pair 51 into baffle 52 and then into transfer station 28 where a developed image is transferred onto the sheet. The cut sheet is then forwarded through transfer station 30 and out of the machine.

In order to cut machine cost, maintain control of the media and monitor the media from initialization to the registration roll pair, three reflective media sensors 33A, 33B, and 33C are employed in the paper path leading to registration roll pair 51. The sensors are configured to provide a dual function. The first function of the sensors is to initialize the media to a predetermined nominal position, for example, if a new roll 14C of media is loaded into machine 10, the media lead edge is indexed into a nominal feed start position once the operator loads the media feed edge into pinch roll pair 32C. That is, after the machine doors are closed, sensor 33C is adapted to sense the lead edge of the media. If the lead edge is not detected, the media is automatically fed forward toward media sensor 33C by pinch roll pair 32C until the lead edge is detected by sensor 33C, pinch roll pair 32C is reversed by a conventional media rewind drive (not shown) for a pre-set time interval with the media lead edge being placed in a predetermined nominal position as shown. If media sensor 33C initially detects the lead edge of the media after the operator loads the media into the machine, pinch roll pair 32C reverses until the media lead edge uncovers the sensor and continues to rewind to the nominal position between pinch roll 32C and sensor 33C. The media initialization procedure is the same when loading media rolls 32B and 32A.

A second function of sensors 33A, 33B and 33C is to monitor progress of media through the machine's predetermined paper path during each feed cycle. The sensors 33A, 33B and 33C monitor the lead edge of the media as it is fed vertically up the media path until the lead edge of each cut sheet reaches registration sensor 35. For example, when an operator selects media roll 14C on control panel 12 and a copying cycle is initiated by the machine's conventional microprocessor controller, pinch roll pair 32C is energized and the media begins to feed toward sensor 33C. The media lead edge will be detected by sensor 33C within a predetermined window. Each of the three sensors 33A, 33B and 33C have a predetermined time window within which the media lead edge should be detected as it progresses toward registration sensor 35. If any of the three media sensors do not detect the media lead edge within the predetermined time interval, a jam is indicated and the machine is stopped automatically for operator interaction.

There are several advantages to dual use of sensors in a three roll media feed system including: the cost effective use of sensors because of their dual use; the minimizing of the number of sensor assemblies required for machine functions; and the enabling of unit manufacturing cost reduction of paper handling hardware.

It should now be understood that it has been disclosed to use media sensors within a media roll feed machine for the dual purpose of positioning the media in a nominal position within the machine's paper path and also serving as jam detectors. The sensors are located in the main paper path in a position which enables them to be used to initialize the lead edge of each roll of media, but then allow the media to back up and move out of the way of media from another location and ensure that the media starts from a known position for timing tracking purposes. When media is coming from a feed roll that is lower in position than others, each sensor along the paper path is used in a timing sequence as a media jam detector.

While the invention has been described with reference to the structure disclosed, it is not intended that the invention be confined to the details set forth, but it is intended to cover modifications or changes as they come within the scope of the following claims.

What is claimed is:

1. A sensing system for a media roll fed copier/-printer, comprising: a plurality of media sensors placed in predetermined positions along a paper path of the copier/printer, each of said plurality of media sensors being adapted for dual functions wherein as a first function they are individually adapted to initialize a lead edge of a media feed roll and in a second function are adapted to act as a jam detector for the media feed roll, and wherein said plurality of media sensors are located in series downstream from each other within said paper path.

2. A method for installing roll media within a copier/-printer and monitoring progress of the media through a predetermined paper path of the copier, comprising the steps of:

a. placing a roll of media into the copier;

b. providing pinch rollers for unwinding media from said roll;

c. providing a plurality of dual function sensors positioned in predetermined positions along said predetermined paper path;

d. threading said roll media into said pinch rollers;

e. sensing a lead edge of said roll media as a first function of said dual function sensors such that (1) if the lead edge of said roll media is not sensed said pinch rollers are actuated to drive said roll media until it is sensed and then reverse said roll media to position the lead edge thereof in a nominal predetermined position, and (2) if the lead edge of said roll media is sensed said pinch rollers are reversed until the lead edge of said roll media reaches a predetermined nominal position; and f. using a second function of said plurality of dual function sensors to detect jams.

3. A copier/printer adapted to print page image information onto media that is roll fed including a media roll sensing system, comprising: a plurality of media sensors placed in predetermined positions along a paper path of said copier/printer, each of said plurality of media sensors being adapted individually for dual functions wherein as a first function they are adapted to initialize a lead edge of a predetermined media feed roll and in a second function are adapted to act as a jam detector for said predetermined media feed roll, and wherein said plurality of media sensors are located in series downstream from each other within said paper path.

4. The copier/printer of claim 3, including a media feed roll positioned upstream of each of said plurality of media sensors.

5. The copier/printer of claim 4, wherein each of said media feed rolls is positioned within a substantially vertical plane with respect to each other.

6. The copier/printer of claim 5, wherein said media sensors are reflective sensors.

7. The copier/printer of claim 3, including a pinch roll pair, and wherein said first function of a predetermined one of said plurality of media sensors is initiated as doors of said copier/printer are closed.

* * * * *